US008039767B2

(12) United States Patent
Saomoto

(10) Patent No.: US 8,039,767 B2
(45) Date of Patent: Oct. 18, 2011

(54) COMPOUND OPERATION INPUT DEVICE

(75) Inventor: Takuhiko Saomoto, Yao (JP)

(73) Assignee: Hosiden Corporation, Yao-Shi (JP)

( * ) Notice: Subject to any disclaimer, the term of this patent is extended or adjusted under 35 U.S.C. 154(b) by 643 days.

(21) Appl. No.: 12/122,828

(22) Filed: May 19, 2008

(65) Prior Publication Data

US 2009/0008233 A1 Jan. 8, 2009

(30) Foreign Application Priority Data

Jul. 3, 2007 (JP) ..... 2007-175058

(51) Int. Cl.
*H01H 25/04* (2006.01)

(52) U.S. Cl. ..... 200/6 A; 200/4; 200/5 R; 200/18

(58) Field of Classification Search ..... 200/4, 5 A, 200/5 R, 6 A, 6 R, 1 R, 17 R, 18, 7; 338/47, 338/68

See application file for complete search history.

(56) References Cited

U.S. PATENT DOCUMENTS

| | | | | |
|---|---|---|---|---|
| 6,124,555 | A | 9/2000 | Isikawa | 200/4 |
| 7,087,848 | B1 * | 8/2006 | Yamasaki et al. | 200/6 A |
| 2005/0190153 | A1 * | 9/2005 | Ushimaru et al. | 345/161 |

FOREIGN PATENT DOCUMENTS

| | | | |
|---|---|---|---|
| DE | 35 02 792 | A1 | 7/1986 |
| EP | 1 524 680 | A2 | 4/2005 |
| EP | 1 715 401 | A1 | 10/2006 |
| EP | 1 988 559 | A1 | 11/2008 |
| JP | 59-206933 | | 11/1984 |
| JP | 61-135421 | | 8/1986 |
| JP | 6-43975 | | 6/1994 |
| JP | 11-67016 | | 3/1999 |
| JP | 11-067016 | | 3/1999 |
| JP | 2001-351478 | A1 | 12/2001 |
| JP | 2006-79407 | | 3/2006 |
| JP | 2006-80053 | | 3/2006 |

OTHER PUBLICATIONS

Office Action dated Dec. 1, 2009 in counterpart Japanese application No. 2007-175058 with English translation.
European Search Report dated Jun. 29, 2010.

* cited by examiner

*Primary Examiner* — Renee S Luebke
*Assistant Examiner* — Marina Fishman
(74) *Attorney, Agent, or Firm* — Kratz, Quintos & Hanson, LLP

(57) ABSTRACT

A compound operation input device includes a case; an operating member for pushing operation, tilting operation and rotating operation, having a push button for pushing operation and a rotary knob for rotating operation; an operation support portion for supporting the operating member in a pushingly, tiltingly and rotatingly operable manner; and at least one of a tilting operation detecting push switch and a pushing operation detecting push switch, disposed to be contactable with a base end side of at least one of the operation support portion and the operating member. The push switch includes a snap plate, and a key top with one end portion contactable with a top portion of the snap plate, the key top being elastically extendable and contractable in an axial direction. An elastic force of the key top is set to be greater than that of the snap plate.

5 Claims, 17 Drawing Sheets

(a)

(b)

COMPOUND OPERATION INPUT DEVICE

The present application claims priority under 35 U.S.C. §119 of Japanese Patent Application No. 2007-175058 filed on Jul. 3, 2008, the disclosure of which is expressly incorporated by reference herein in its entity.

BACKGROUND OF THE INVENTION

1. Field of the invention

The present invention relates to a compound operation input device that can be utilized for input to various game machines, a car navigation system, a car audio system, a car air-conditioner, and an adjustment device of car mirrors, and that outputs signals according to tilting operation, rotating operation, and pushing operation of an operation lever.

2. Description of the Related Art

The device of this type is called multifunction switch. As related art, there are a switch (as disclosed in Japanese Patent Application Laid-open No. 2001-351478) in which a push switch is used to detect tilting operation and pushing operation and a switch (as disclosed in Japanese Patent Application Laid-open No. 11-67016) in which a push switch and a rotary switch are used to detect tilting operation and rotating operation.

A multifunctional switch as described above often includes a push switch because it can easily provide a tactile click feel in operation.

However, a conventional switch as described above has the following drawbacks. A high load applied on a snap plate of a push switch due to improper operation would cause failure of a contact portion. Moreover, a demand for letters and graphics put on a head portion of a rotary knob cannot be satisfied because the head portion of the rotary knob also rotates by the rotating operation.

SUMMARY OF THE INVENTION

The present invention has been made against the above-described background and it is a main object of the invention to provide a compound operation input device that is less prone to contact failure due to improper operation.

A compound operation input device according to the present invention includes a case; an operating member for pushing operation, tilting operation and rotating operation, having a push button for pushing operation and a rotary knob for rotating operation; an operation support portion for supporting the operating member in a pushingly, tiltingly and rotatingly operable manner; and at least one of a tilting operation detecting push switch and a pushing operation detecting push switch, disposed to be contactable with a base end side of at least one of the operation support portion and the operating member. The push switch includes a snap plate, provided integrally with or separately from a movable contact corresponding to a fixed contact, and a key top with one end portion contactable with a top portion of the snap plate, the key top being elastically extendable and contractable in an axial direction. An elastic force of the key top is set to be greater than that of the snap plate.

In the compound operation input device according to the invention, the tilting operation detecting push switch and/or the pushing operation detecting push switch has the key top that is elastically extendable and contractable, and the elastic force of the key top is set to be greater than that of the snap plate. Therefore, as a load acts on the key top via the operating member and the snap plate will not take an excessive load. If the elastic force of the key top is set to be greater than that of the snap plate and smaller than a load that would cause a failure of the snap plate, it is possible to reduce contact failures caused by improper operation. Moreover, because the push button and the rotary knob are formed as separate bodies, operation of the rotary knob would not lead to an operation mistake such as turning on of the push button.

In the above described compound operation input device, the key top of the push switch may preferably include a distal end side main body, a base end side main body and a spring interposed between them.

When the push switch is used for detecting tilting operation, it is possible to lengthen a stroke in tilting the operating member. The long stroke has a further merit of improved feel in operation, namely, providing a user with a feel that he/she has actually moved the operating member, as well as a click feel.

Preferably, the above compound operation input device may further include a plurality of operating member returning elastic bodies, disposed at regular intervals around an operating member insertion hole in an operation face of the case so as to directly or indirectly come in contact with and give biasing forces to an outer surface of a shaft portion of the operating member.

In this case, the biasing forces of the tilting operation returning elastic bodies for returning the tilted operating member are directed substantially perpendicular to the elastic force of the key top. Therefore, a load of the tilting operation can be set separately from a load of the pushing operation, leading to a balanced load setting.

It is preferable that the operating member may include an inner shaft in addition to the push button and the rotary knob. The inner shaft may include a shaft portion to pass through an operating member insertion hole in the case, and a hemispherical support portion disposed coaxially on a base end side of the shaft portion and having an end face contactable with the other end face of the key top of the pushing operation detecting push switch.

The above described compound operation input device may further include a wobble preventing spring, disposed to surround the pushing operation detecting push switch and having a distal end side adapted to contact with and axially bias the end face of the hemispherical support portion of the operating member.

In this case, it is possible to prevent the inner shaft from wobbling, which is a further merit of improved feeling in operation.

It is preferable that the operation support portion includes a fixed portion provided in the case to face the operating member insertion hole; and an outer shaft supported on the fixed portion. The fixed portion may including a hemispherical shell-shaped bearing portion, whose inner diameter side is adapted to axially support the inner shaft for tilting operation, and whose outer diameter side is adapted to axially support the outer shaft for rotating and tilting operation in a state where the outer shaft is coaxial with the inner shaft; and an opening, formed at a top of the bearing portion for passing through the shaft portion of the inner shaft. The outer shaft may include a hemispherical shell-shaped outer bearing portion axially supported in a rotatingly and tiltingly operable manner in a state where a distal end side of the bearing portion of the fixed portion is placed inside the outer bearing portion; a cylindrical portion, comprising a hollow shaft for inserting the shaft portion of the inner shaft therethrough and communicating with the outer bearing portion; and a pushing portion, provided around a base end side opening of the outer bearing portion so as to push the tilting operation detecting push switch. The push button may be connected to a distal end of the shaft portion of the inner shaft extending out of the cylindrical portion of the outer shaft, and the rotary knob may be connected to a distal end portion of the cylindrical portion of the outer shaft.

In this case, aligned axial centers of the inner shaft and the outer shaft allow the tilting operation without impairing a positional relationship between the inner shaft and the outer shaft and without interference between them. The inner shaft is axially centered based on the inner diameter side of the bearing portion of the fixed portion of the operation support portion, while and the outer shaft is axially centered based on the outer diameter side of the bearing portion. Consequently, the axial centers are less likely to be displaced in assembly and thus it is possible to ease assembly and die molding of the device.

Preferably, an outer surface of the hemispherical support portion of the inner shaft may be provided with a pair of grooves arranged in the axial direction and in symmetric positions with respect to an axial center, and an inner face of the bearing portion of the fixed portion of the operation support portion is provided with a pair of bosses to be received in the pair of grooves, the pair of bosses being located at the same height as a tilting operation center of the hemispherical support portion of the operating member so as to allow the tilting operation of the inner shaft and prevent the rotating operation of the inner shaft.

In this case, because the push button does not rotate as the rotary knob is rotated, it is possible to put letters or graphics on the head portion of the push button, which improves usability of the input device.

The input device of the invention preferably includes an annular rotary body rotatably provided around an outside of the outer shaft; and a rotating operation detecting sensor for detecting rotation of the annular rotary body. An outer surface of the pushing portion of the outer shaft is provided with a pair of bosses arranged in symmetric positions with respect to an axial center, and an inner side of the annular rotary body is provided with a pair of grooves arranged in the axial direction to receive the pair of bosses on the outer surface of the pushing portion of the outer shaft.

In this case, the rotating operation is detected by using the rotating operation detecting sensor. Consequently, there is a further merit that it is possible to avoid contact wear and prolong the life.

Moreover, the outer shaft and the annular rotary body are coupled by means of the pair of bosses formed on the outer surface of the pushing portion of the outer shaft and the pair of groove portions formed on the inner side of the annular rotary body. The input device in this configuration does not require a special coupling mechanism between the outer shaft and the annular rotary body, and thus can be manufactured in reduced cost.

BRIEF DESCRIPTION OF THE DRAWINGS

FIG. 4 is a perspective view of a lower case of the device viewed from an inner face side and showing also key tops and the like;

DESCRIPTION OF THE PREFERRED EMBODIMENTS

An embodiment of the present invention will be described with reference to the drawings.

Figure 1:
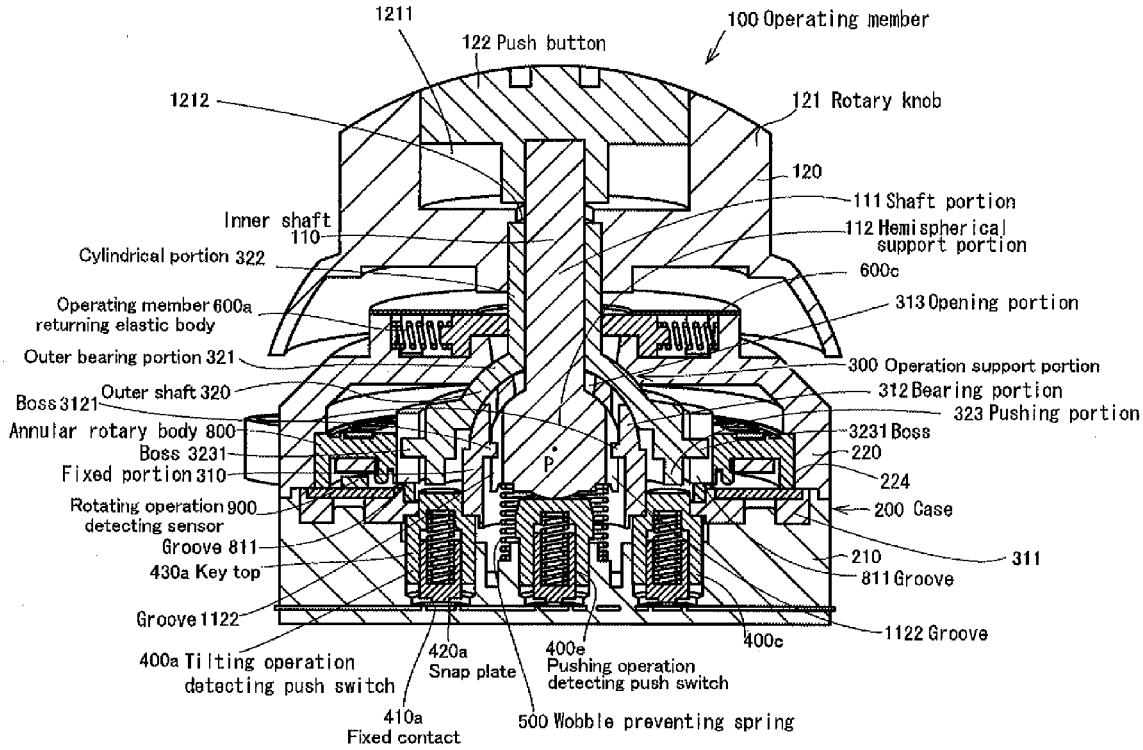
FIG. 1 is a view for explaining an embodiment of the present invention and a vertical sectional view of a compound operation input device.

The compound operation input device described herein is a device for outputting signals according to tilting operation, rotating operation, and pushing operation of a operating member 100. As shown in FIG. 1 and other figures, the input device includes: a case 200; an operation support portion 300 for supporting the operating member 100 allowing the above-described operations; tilting operation detecting push switches 400*a*-400*d* and a pushing operation detecting push switch 400*e* disposed to be able to come in contact with base end sides of the operation support portion 300 and the operating member 100; an annular rotary body 800 rotatingly arranged around the operation support portion 300; rotating operation detecting sensors 900 for detecting rotation of the annular rotary body 800; the wobble preventing spring 500; and operating member returning elastic bodies 600*a*-600*d*.

Especially, the tilting operation detecting push switches 400*a*-400*d* and the pushing operation detecting push switch 400*e* have snap plates 420*a*-420*e* integrally provided with movable contacts corresponding to fixed contacts 410*a*-410*e* and key tops 430*a*-430*e* having distal ends in contact with top portions of the snap plates 420*a*-420*e* and being adapted to elastically extend and contract in an axial direction. Elastic forces of the key tops 430*a*-430*e* are set to be greater than those of the snap plates 420*a*-420*e* but smaller than such loads as to break the plates.

Respective elements of the device will be described below in detail.

The operating member 100 is a resin molded article having a shaft-shaped inner shaft 110 and a disk-shaped operating knob 120 provided on a distal end side of the inner shaft 110.

Figure 2:
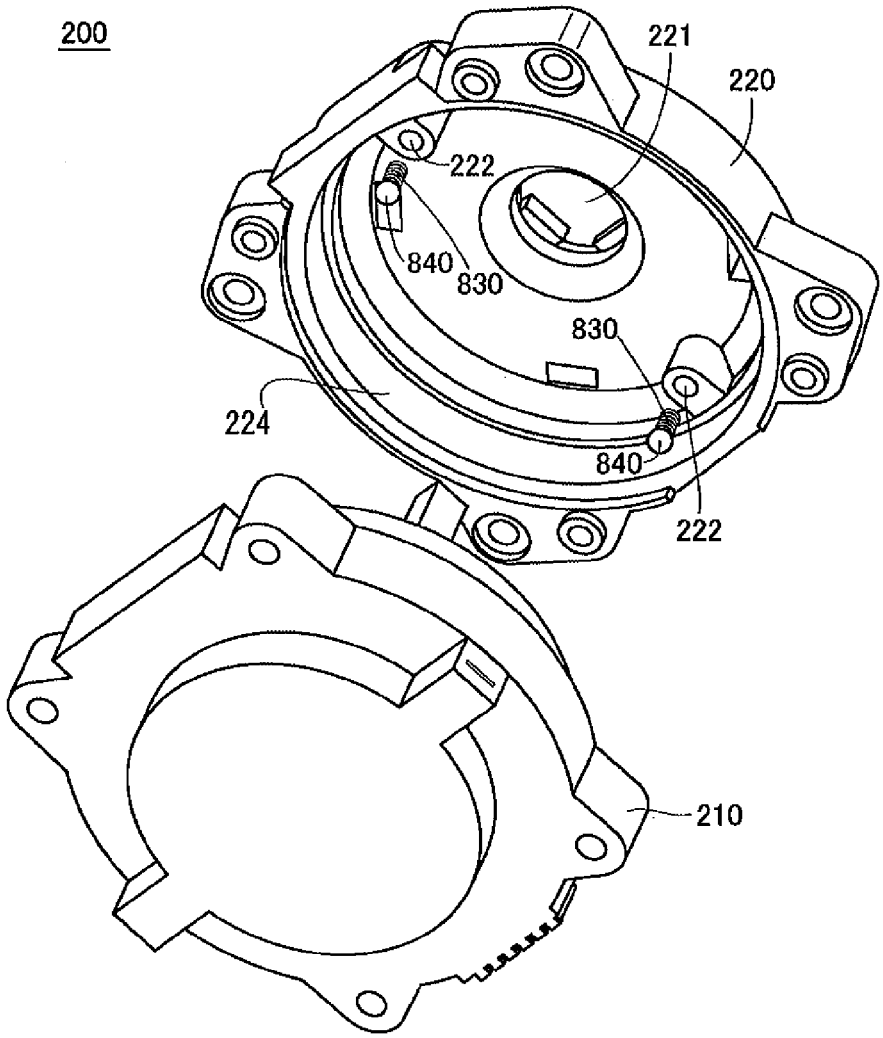
FIG. 2 is an exploded perspective view of a case of the device.
Figure 12:
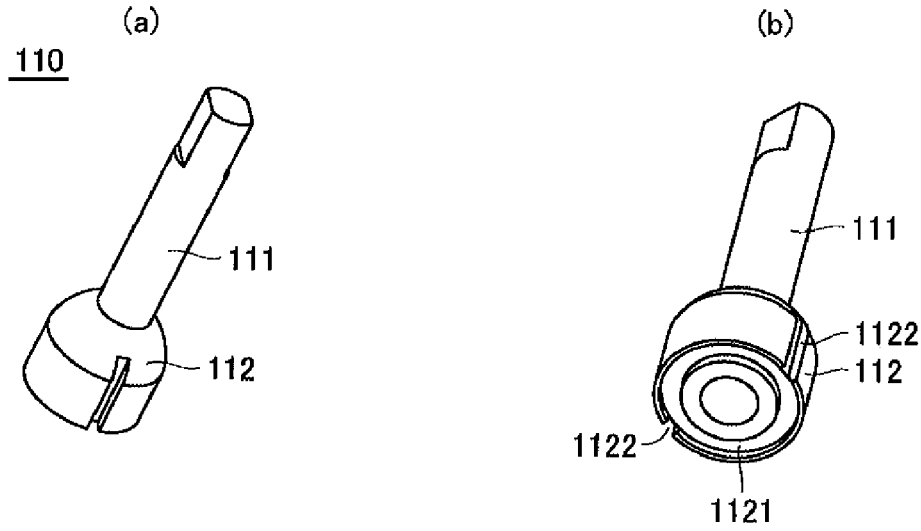
FIGS. 12(*a*) and 12(*b*) are perspective views of the inner shaft of the operating member of the device, wherein FIG. 12(*a*) shows the inner shaft viewed from a front side and FIG. 12(*b*) shows the same viewed from a back side.

As shown in FIG. 2 and FIGS. 12(*a*) and 12(*b*), the inner shaft 110 has a shaft portion 111, insertable through an operating member insertion hole 221 in the case 200, and a hemispherical support portion 112, disposed coaxially on a base end side of the shaft portion 111. A lower end face of the hemispherical support portion 112 is in contact with a distal end face of the key top 430*e* of the pushing operation detecting push switch 400*e*.

On an outer surface of the hemispherical support portion 112, a pair of grooves 1122 is formed along an axial direction in symmetric relations with respect to the axial center.

The operating knob 120 has a push button 122 disposed at a central portion of a front surface thereof and a rotary knob 121 formed in such a shape as to surround the push button 122 as shown in FIG. 1. A central portion of a front surface of the rotary knob 121 is provided with a recessed portion 1211 for accommodating the push button 122. A central portion of a back side of the rotary knob 121 is provided with a through hole 1212 for inserting therethrough a cylindrical portion 322 of an outer shaft 320 (described later) and the shaft portion 111 of the inner shaft 110.

The push button 122 is connected to a distal end of the shaft portion 111 of the inner shaft 110 while the rotary knob 121 is connected to a distal end of the cylindrical portion 322 of the outer shaft 320.

The push button 122 can be pushed down and is used independently as an operating member for pushing operation. The rotary knob 121 can be rotated and is used independently as an operating member for rotating operation. The whole operating knob 120 having the push button 122 and the rotary knob 121 can be tilted. In other words, the push button 122 and the rotary knob 121 can used in combination as an operating member for tilting operation.

Figure 3:
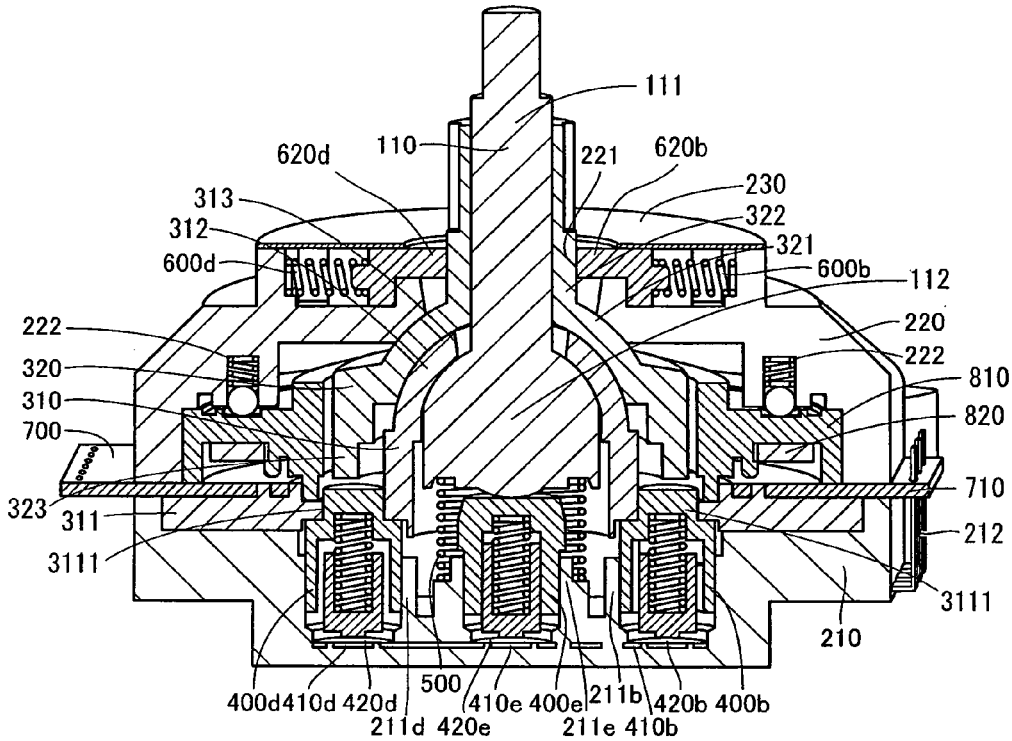
FIGS. 3(*a*) and 3(*b*) are vertical sectional views of the device from which an operating knob is detached, wherein FIG. 3(*a*) shows a state in which an operating member is in a center position and FIG. 3(*b*) shows a state in which the operating member is tilted.
Figure 3:
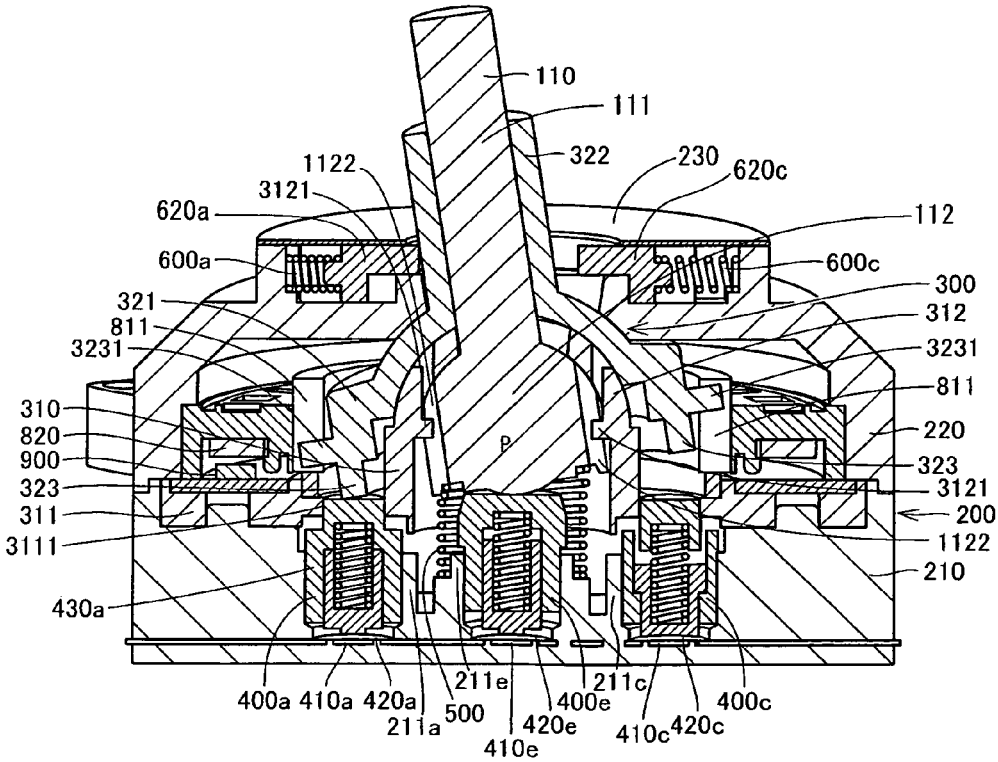

The case 200 has a lower case 210 and an upper case 220, which are resin molded articles of substantially U section as shown in FIG. 2. The upper case 220 has the operating member insertion hole 221 formed at a central portion thereof and a groove 224 formed circumferentially of a lower inner face thereof. As shown in FIGS. 2 and 3(*a*), spring/steel-ball insertion holes 222 are each formed in two positions on a bottom face of the groove 224.

Figure 4:
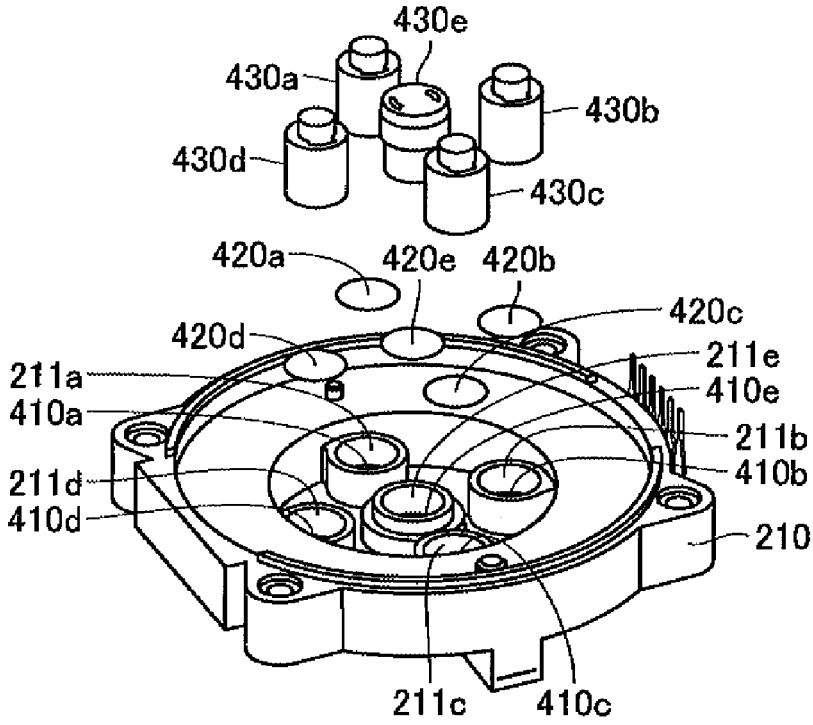

Cylindrical bodies 211*a*-211*e* are formed on the inner bottom of the lower case 210 as shown in FIG. 4.

The cylindrical body 211*e* is arranged in a position corresponding to a center of the operating member insertion hole 221 in the upper case 220. On an inner bottom face of the cylindrical body 211*e*, the fixed contact 410*e* is insert-molded, on top of which the snap plate 420*e* and the key top 430*e* are inserted in this order.

The cylindrical bodies 211*a*-211*d* are disposed at intervals of 90° around the cylindrical body 211*e*. In exactly the same way as the cylindrical body 211*e*, the fixed contacts 410*a*-410*d* are insert-molded on the bottom faces of the cylindrical bodies 211*a*-211*d*, and the snap plates 420*a*-420*d* and the key tops 430*a*-430*d* are inserted in this order into them.

A side face portion of the lower case 210 is provided, by insert molding, with terminals 212 for contact output, electrically connected to the fixed contacts 410*a*-410*e* and the snap plates 420*a*-420*e*.

The tilting operation detecting push switch 400*a* has the fixed contact 410*a*, the snap plate 420*a* that is a circular curved thin metal plate integral with the movable contact corresponding to the fixed contact 410*a*, and the key top 430*a* having the base end in contact with the snap plate 420*a* and being capable of elastically extending and contracting in the axial direction.

Figure 8:
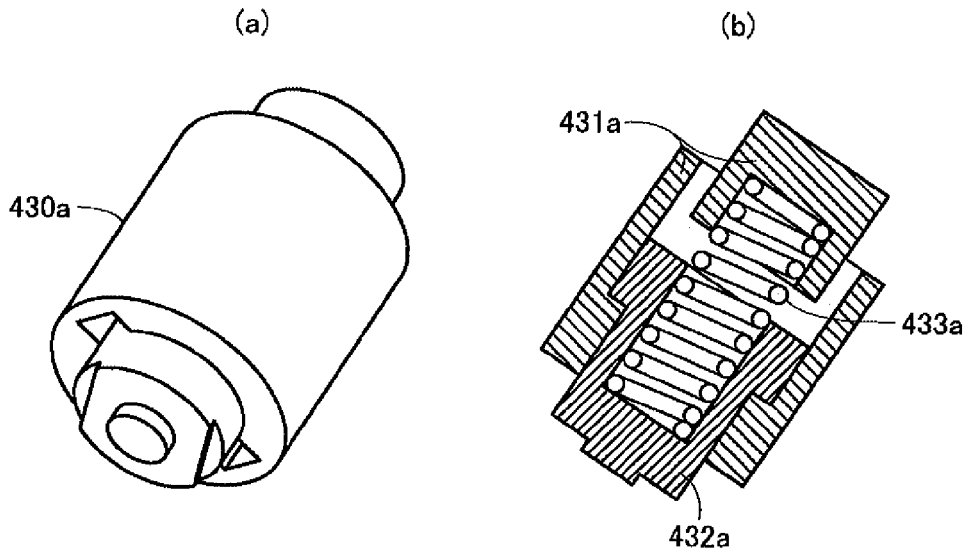
FIGS. 8(*a*) and 8(*b*) are views showing a key top of a tilting operation detecting push switch of the device, wherein FIG. 8(*a*) is a perspective view and FIG. 8(*b*) is a vertical sectional view.
Figure 9:
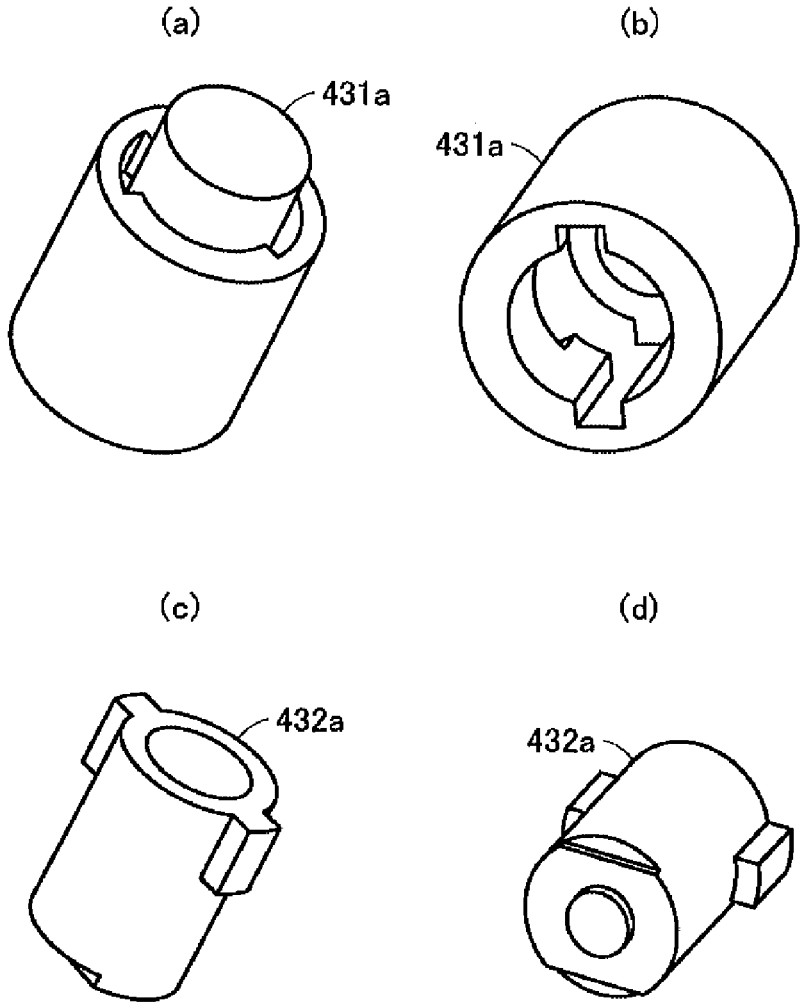
FIGS. 9(*a*) to 9(*d*) are perspective views of parts of the key top of the device, wherein FIG. 9(*a*) shows a distal end side main body viewed from a front side, FIG. 9(*b*) shows the same viewed from a back side, FIG. 9(*c*) shows a base side main body viewed from the front side, and FIG. 9(*d*) shows the same viewed from the back side.

In the key top 430*a*, as shown in FIGS. 8(*a*) to 9(*d*), a spring 433*a* is interposed between a distal end side main body 431*a* and a base end side main body 432*a*. Both the distal end side main body 431*a* and base end-side main body 432*a* are each of cylindrical shape with one opening and molded of plastics material. The base end side main body 432*a* is inserted into the distal end side main body 431*a* such that the spring 433*a* can extend and contract in the axial direction.

The spring 433*a* is housed inside the distal end side main body 431*a* and the base end side main body 432*a*. As described above, the elastic force of the spring 433*a* is set to be greater than that of the snap plate 420*a* and smaller than the load that would cause a failure of the plate.

Figure 10:
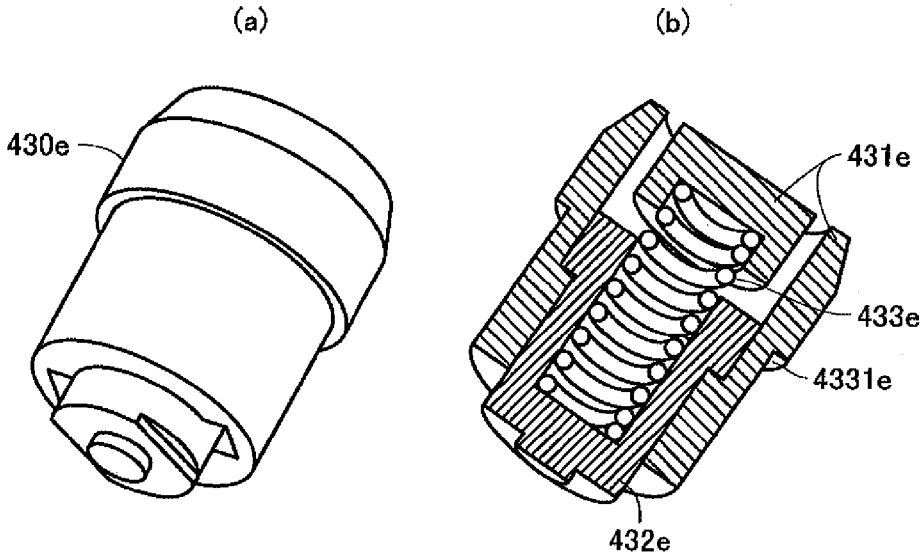
FIGS. 10(*a*) and 10(*b*) are views showing a key top of a pushing operation detecting push switch of the device, wherein FIG. 10(*a*) is a perspective view and FIG. 10(*b*) is a vertical sectional view.
Figure 11:
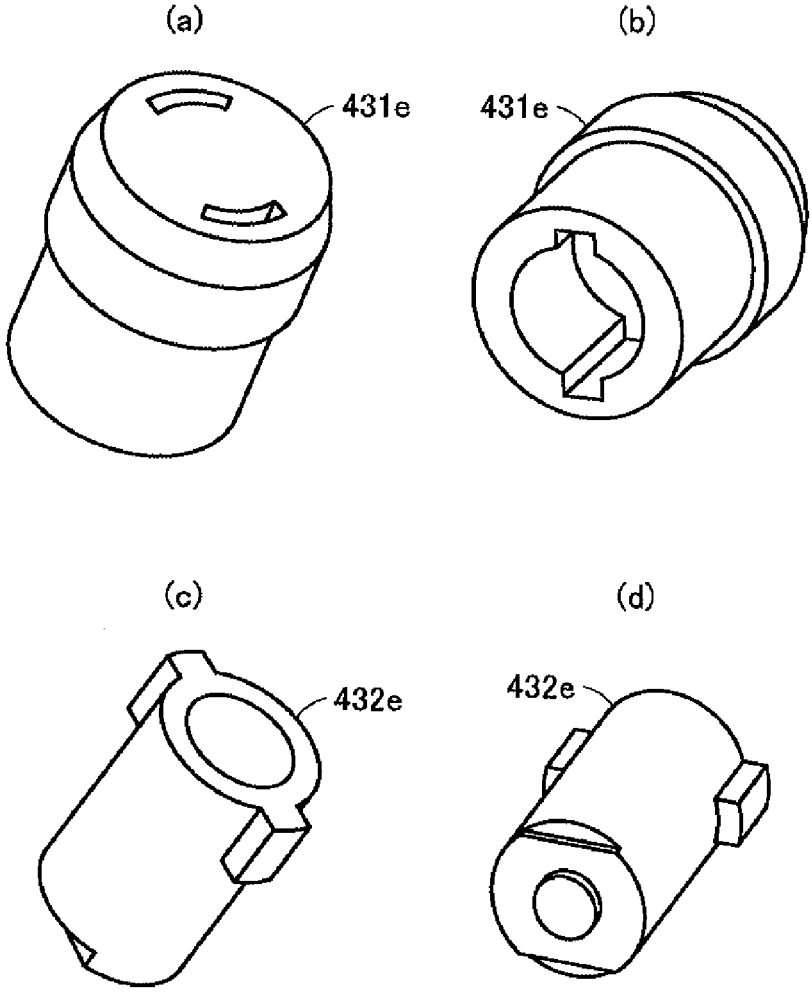
FIGS. 11(*a*) to 11(*d*) are perspective views of parts of the key top of the device, wherein FIG. 11(*a*) shows a distal end side main body viewed from a front side, FIG. 11(*b*) shows the same viewed from a back side, FIG. 11(*c*) shows a base side main body viewed from the front side, and FIG. 1(*d*) shows the same viewed from the back side.

The tilting operation detecting push switches 400*b*-400*d* have the same structures as the tilting operation detecting push switch 400*a*. The pushing operation detecting push switch 400*e* also has a similar structure except that a step 4331*e* is formed on an outer peripheral face of the distal end side main body 431*e* as shown in FIGS. 10(*a*)-11(*d*). By abutting the cylindrical body 211*e* of the lower case 210 in the pushing operation, the step 4331*e* functions as a stopper for preventing the distal end side main body 431*e* from being pushed too much.

Figure 5:
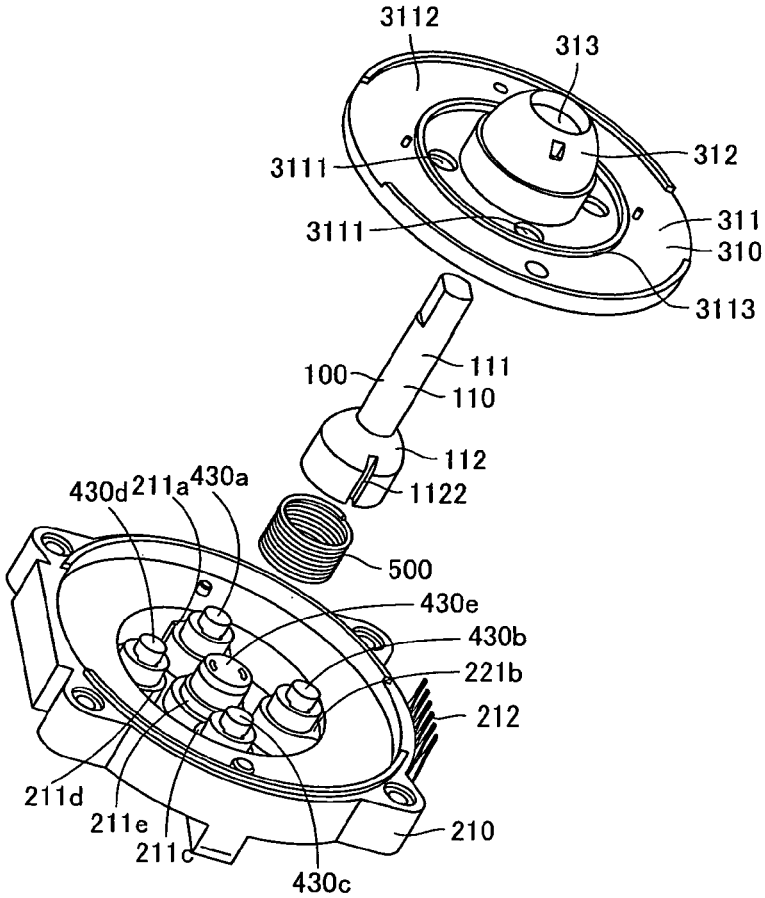
FIG. 5 is an exploded perspective view of the lower case, a wobble preventing spring, an inner shaft of an operating member, a fixed portion of an operation support portion, and the like of the device.

The wobble preventing spring 500 is disposed around the pushing operation detecting push switch 400*e* as shown in FIG. 5. A distal end side of the wobble preventing spring 500 abut and axially bias a bottom face 1121 (see FIG. 12(*b*)) of the hemispherical support portion 112 of the inner shaft 110 of the operating member 100.

The operation support portion 300 has a fixed portion 310 provided to face the operating member insertion hole 221 in the case 200, as shown in FIG. 1, and the outer shaft 320 supported on the fixed portion 310

As shown in FIG. 5, the fixed portion 310 molded of plastics material is in substantially disk-shape and attached to the inner face of the lower case 210. The fixed portion 310 has an annular bearing stand 311, a hemispherical shell-shaped bearing portion 312 provided in the center of the bearing stand 311, and an opening 313 formed at a top of the bearing portion 312 for passing through the inner shaft 110. The inner diameter side (inner surface) of the bearing portion 312 is adapted to axially support the inner shaft 110 in a tiltingly operable manner, while the outer diameter side (outer surface) is adapted to axially support the outer shaft 320 in a rotatingly and tiltingly operable manner. The hemispherical shell-shaped bearing portion 312 axially supports the inner shaft 110 and the outer shaft 320 so that a tilting operation center of the inner shaft 110 and a tilting operation center of the outer shaft 320 are aligned with a point P (see FIGS. 1 and 3(*b*)).

Figure 6:
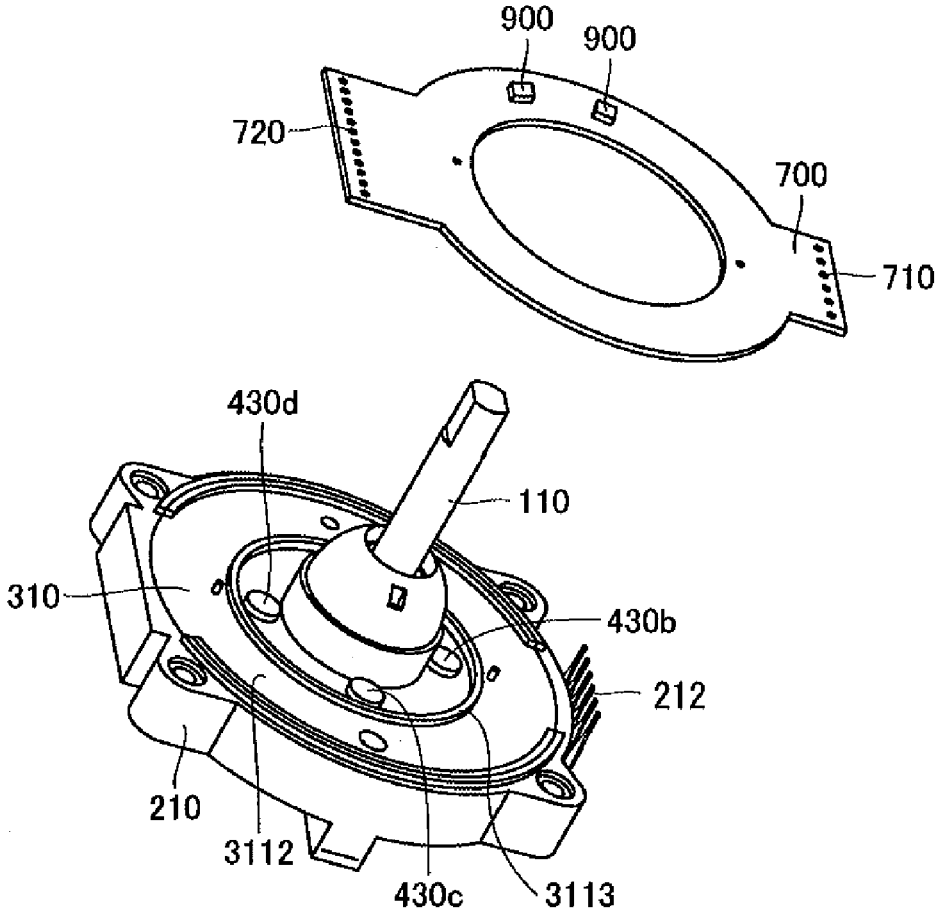
FIG. 6 is an exploded perspective view of the fixed portion of the operation support portion, the inner shaft of the operating member, the printed circuit board, and the like of the device.

The bearing stand 311 is formed with holes 3111 in positions corresponding to the respective key tops 430*a*-430*d*. In other words, the bearing stand 311 is mounted to the lower case 210 to cover the cylindrical bodies 211*a*-211*d* while head portions of the key tops 430*a*-430*d* are exposed through the holes 3111 as shown in FIG. 6. Around the four holes 3111 in total on the surface of the bearing stand 311, there is provided a support table 3112 of an annular shape, on which a substantially ring-shaped printed circuit board 700 is placed. Between the support table 3112 and the four holes 3111, there is a protrusion 3113 of an annular shape.

Figure 13:
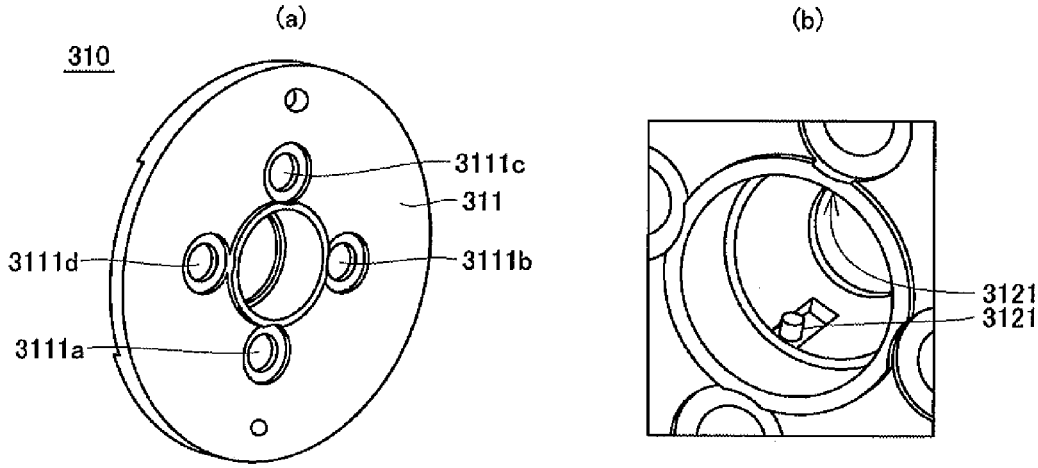
FIGS. 13(*a*) and 13(*b*) are perspective views of the fixed portion of the operation support portion of the device, wherein FIG. 13(*a*) shows the fixed portion viewed from a back side and FIG. 13(*b*) is a partial enlarged view of the same viewed from the back side.

An inner face of the bearing portion 312 is provided with a pair of bosses 3121 for fitting in the pair of grooves 1122 formed in the hemispherical support portion 112 of the inner shaft 110 as shown in FIGS. 13(*a*) and 13(*b*). The bosses 3121 are located at the same height as the tilting operation center P (see FIGS. 1 and 3(*b*)) of the inner shaft 110. Consequently, the bosses 3121 allow the tilting operation of the inner shaft 110 but prevent the rotating operation of the inner shaft 110.

Figure 7:
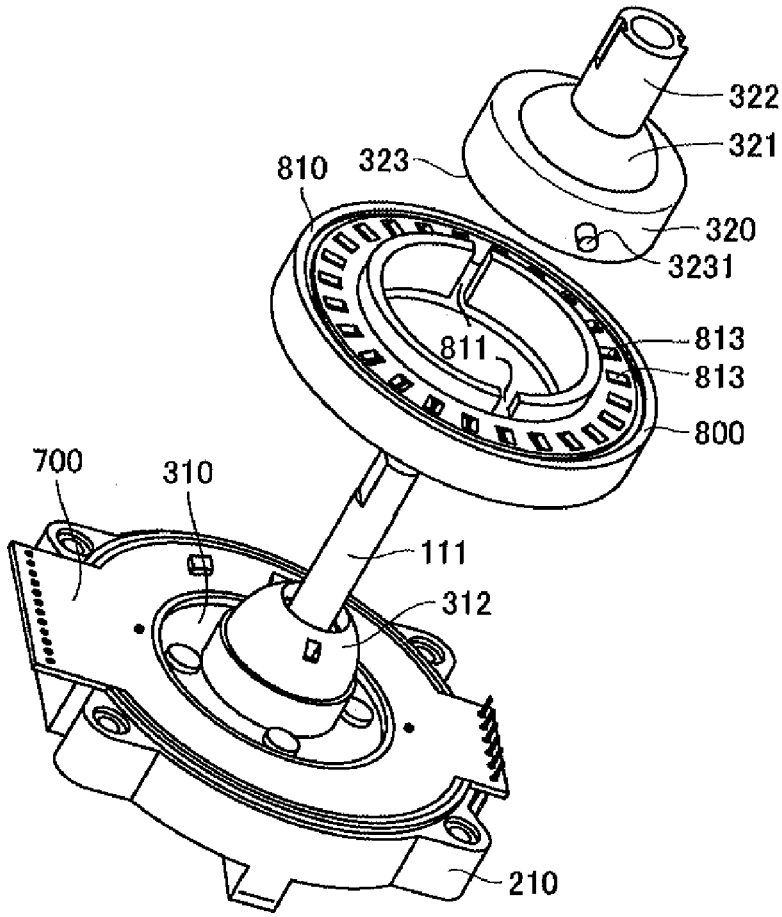
FIG. 7 is an exploded perspective view of the fixed portion of the operation support portion, an outer shaft of the operation support portion, the inner shaft of the operating member, and an annular rotary body of the device.

As shown in FIG. 7, the outer shaft 320 has a hemispherical shell-shaped outer bearing portion 321, a cylindrical portion 322 and a pushing portion 323. The outer bearing portion 321 is axially supported on the bearing portion 312 in a rotatingly and tiltingly operable manner in a state where it receives the outer diameter side of the bearing portion 312 of the fixed portion 310. The cylindrical portion 322 is hollow so as to pass through the shaft portion 111 of the inner shaft 110 and communicates with the outer bearing portion 321. The pushing portion 323 is provided around a base end side opening of the outer bearing portion 321 to be able to push the head portions of the key tops 430*a*-430*d* of the tilting operation detecting push switches 420*a*-420*d*.

Figure 14:
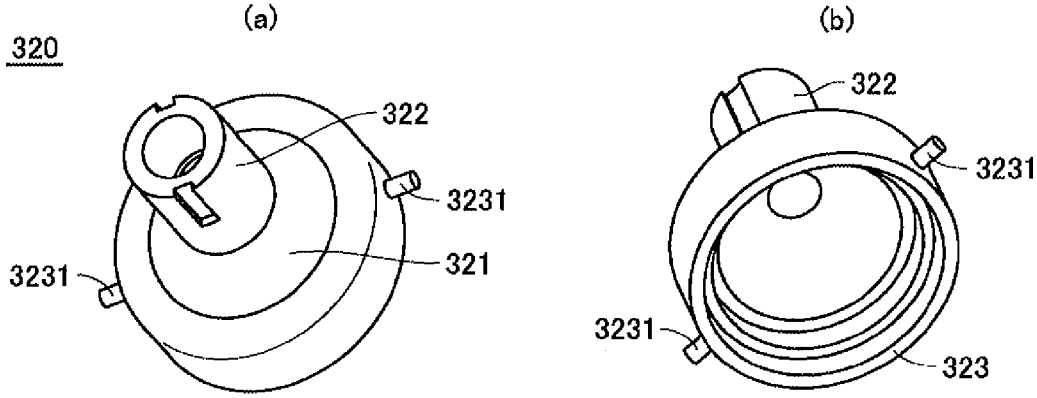
FIGS. 14(*a*) and 14(*b*) are perspective views of the outer shaft of the operation support portion of the device, wherein FIG. 14(*a*) shows the outer shaft viewed from a front side and FIG. 14(*b*) shows the same viewed from a back side.

On an outer surface of the pushing portion 323, a pair of bosses 3231 are formed in symmetric positions with respect to the axial center as shown in FIGS. 14(*a*) and 14(*b*).

Figure 15:
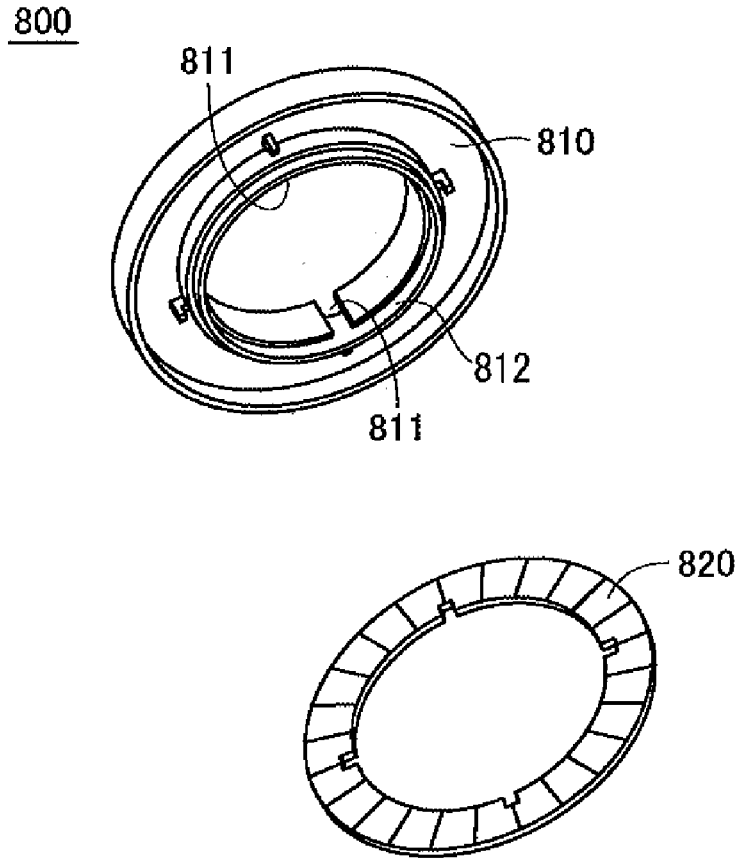
FIG. 15 is an exploded perspective view of the annular rotary body of the device viewed from a back side.

The annular rotary body 800 is an annular body having a greater inner diameter than a large diameter portion of the outer shaft 320. As shown in FIG. 15, the annular rotary body 800 has a main body 810 molded of plastics material and a magnet 820 attached to a back side of the main body 810. The magnet 820 is formed of a plurality of pole pieces arranged at regular intervals in the circumferential direction. On a front side of the main body 810, rotation detent asperities 813 are formed at regular intervals in the circumferential direction as shown in FIG. 7.

On the lower inner side of the main body 810 of the annular rotary body 800, a rib 812 extends along the circumferential direction. On an upper inner side of the main body 810, a pair of grooves 811 for receiving the pair of bosses 3231 of the outer shaft 320 are formed along the axial direction. The pair of bosses 3231 are located at the same height as the tilting operation center P of the outer shaft 320.

In summary, the pair of bosses 3121 formed in the bearing portion 312 and the pair of bosses 3231 formed in the outer shaft 320 are positioned at the same height as P that is the tilting operation center of the outer shaft 320 and the tilting operation center of the inner shaft 110. Moreover, because the pair of bosses 3231 formed on the outer shaft 320 are in the symmetric positions with respect to the axial center P, a boss axis connecting the opposite bosses 3231 also passes through the axial center P. In other words, even in the tilting operation, the boss axis does not deviate from the axial center P. The above arrangements allows smooth tilting operation in any directions.

The rib 812 of the annular rotary body 800 is inserted inside the protrusion 3113 of the fixed portion 310 shown in FIG. 5 so as to come in contact with a face of the printed circuit board 700 placed on the bearing stand 311. The main body 810 is inserted into the groove 224 in the upper case 220 as shown in FIG. 1. In this manner, the annular rotary body 800 is axially supported in a sandwiched state between the bearing stand 311 and the upper case 220, and is rotatably coupled to the rotary knob 121 of the operating member 100 via the outer shaft 320.

In the spring/steel-ball insertion holes 222 shown in FIGS. 2 and 3(*a*), rotation detent springs 830 and steel-balls 840 are inserted so that the steel balls 840 can be brought into biasing contact with the rotation detent asperities 813 of the annular rotary body 800. It should be noted here that the number and relative positions of the rotation detent springs 830 and steel balls 840 may be changed appropriately depending on what the device is applied to.

The rotating operation detecting sensors 900 are two Hall elements that are mounted on an upper face of the printed circuit board 700 as shown in FIG. 6. The sensors 900 detects a magnetic field of the magnet 820 of the annular rotary body 800 and outputs relative rotating angle and rotating direction of the annular rotary body 800 as two-phase digital signals. Although such noncontact angle sensors are used in this embodiment to detect rotation of the annular rotary body 800, they may be replaced with contact sensors.

The printed circuit board 700 is provided with relay terminals 710, output terminals 720 and the like besides the rotating operation detecting sensors 900. The relay terminals 710 and the output terminals 720 are located outside the case 200. The relay terminals 710 are soldered to distal ends of the contact output terminals 212 taken out of the lower case 210; while the output terminals 720 are electrically connected to lead wires, connectors and the like.

Figure 16:
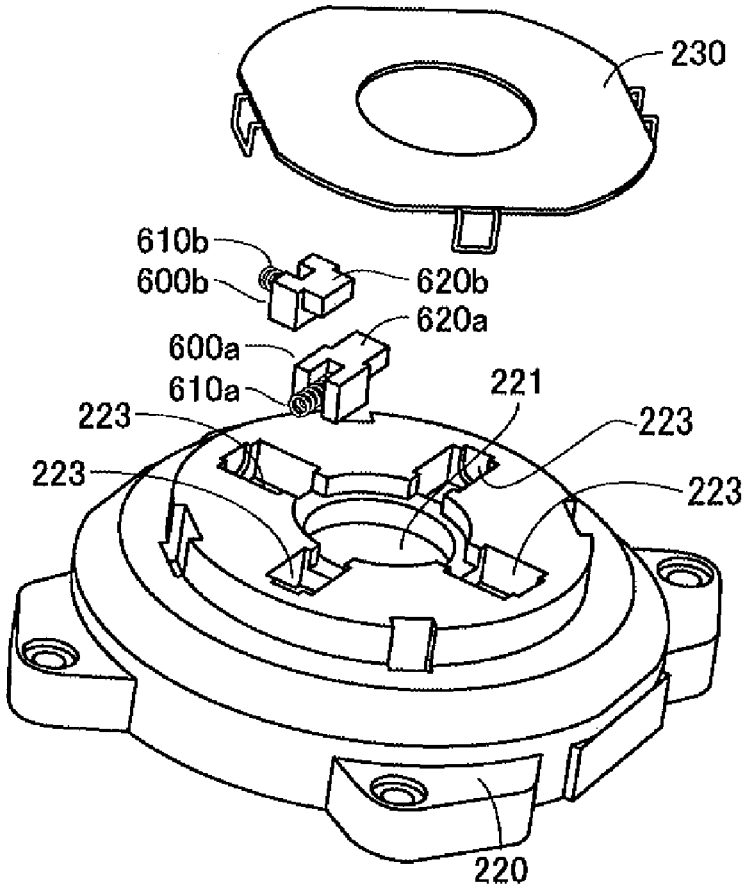
FIG. 16 is a perspective view of an upper case of the device viewed from a front side and showing also operating member returning elastic bodies.
Figure 17:
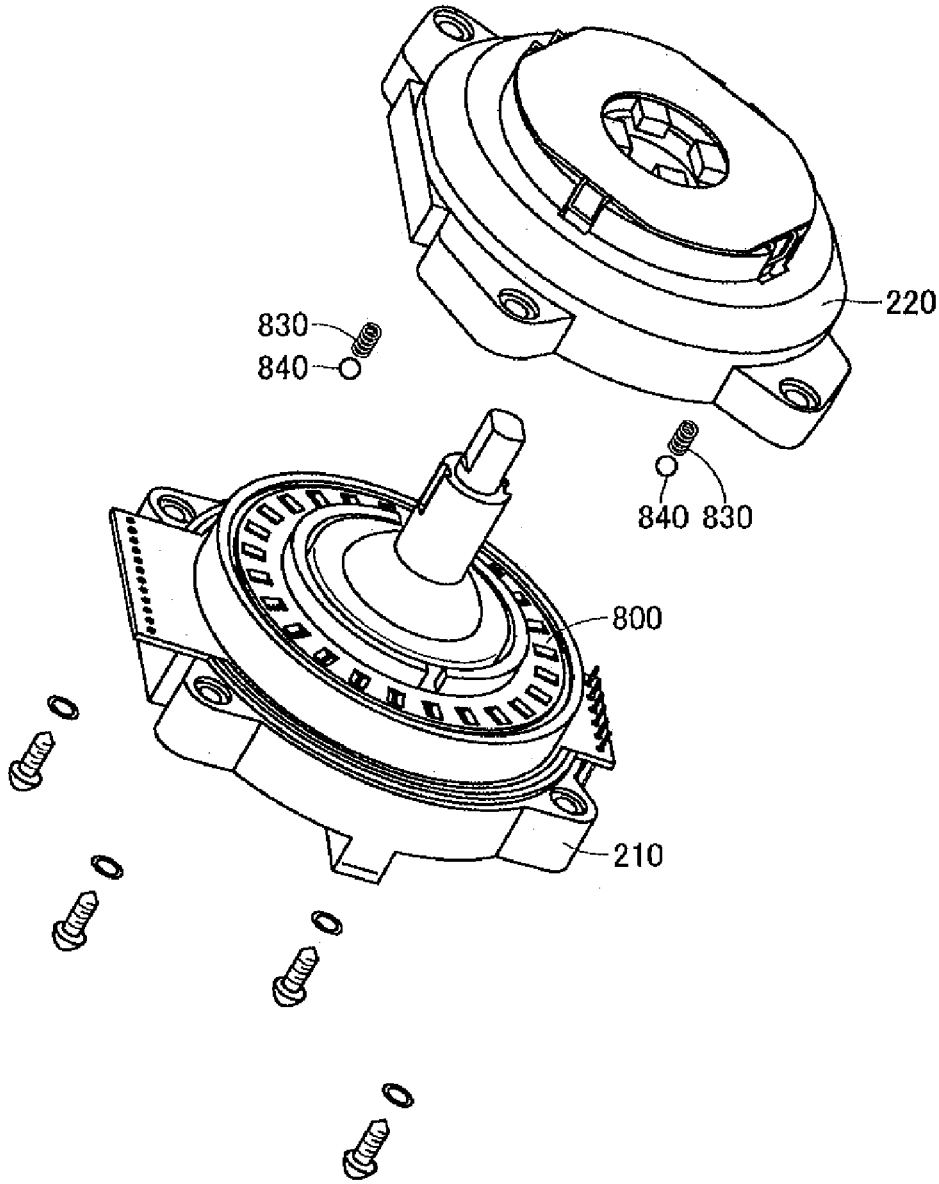
FIG. 17 is an exploded perspective view of the device.

As shown in FIG. 16, the operating member returning elastic bodies 600*a*-600*d* are housed in respective returning elastic body mounting holes 223 formed at intervals of 90° around the operating member insertion hole 221 in an operation face of the upper case 220. The elastic bodies 600*a*-600*d* have springs 610*a*-610*d* and sliders 620*a*-620*d* attached to distal end portions of the springs 610*a*-610*d*. Distal end portions of the sliders 620*a*-620*d* abut and bias an outer surface of the cylindrical portion 322 of the operation support portion 300.

The cylindrical bodies 211*a*-211*d* formed in the lower case 210 and the returning elastic body mounting holes 223 formed in the upper case 220 are both arranged at intervals of 90°. An annular top plate 230 made of metal is mounted on the operation face of the upper case 220 to cover the returning elastic body mounting holes 223 accommodating the operating member returning elastic bodies 600*a*-600*d*.

Operations and functions of the compound operation input device configured as described above will be described below.

The operating knob 120 (the rotary knob 121 and the push button 122) of the operating member 100 can be tilted from the center to any direction. For example, if the operating member 100 is tilted from the center in a direction toward the tilting operation detecting push switch 400*a* (a direction angle of 0°), the outer shaft 320 of the operation support portion 300 tilts in that direction.

As a result, the pushing portion 323 of the operation support portion 300 pushes the head portion of the key top 430*a*.

Then, the snap plate 420*a* bends to turn on the tilting operation detecting push switch 400*a* and the corresponding contact output is output through the output terminals 720.

If the operating member 100 is tilted further, an outer surface of the outer shaft 320 comes in contact with an edge of the operating member insertion hole 221 of the upper case 220. In this way, the edge of the operating member insertion hole 221 functions as a stopper so as to prevent the snap plate 420*a* from taking a force equal to or greater than the spring load.

Exactly the same operation can be obtained when the operating member 100 is tilted from the center in a direction toward the tilting operation detecting push switches 400*b*, 400*c*, or 400*d* (direction angles of 90°, 180° or 270°). In other words, the tilting operation detecting push switches 400*b*, 400*c*, and 400*d* are respectively turned on and their corresponding contact outputs are output through the output terminals 720. If the operating member 100 is tilted further, the edge of the operating member insertion hole 221 functions as a stopper so as to prevent the snap plates 420*b*, 420*c*, and 420*d* from taking forces equal to or greater than the spring loads.

In the above embodiment, a stroke of tilt of the operating member 100 is long (the maximum tilt angle of about eight degrees) because (a) the key tops 430*a*-430*d* of the tilting operation detecting push switches 400*a*-400*d* can extend and contract and (b) the tilting operation detecting push switches 400*a*-400*d* can be further pushed in even after the snap plates 420*a*-420*d* are turned on. The long stroke in the tilting operation thus provides a user with a feel that he/she has actually moved the operating member, as well as a click feel. The click feel may be eliminated by changing the elastic forces of the snap plates 420*a*-420*d* to weak settings.

Because of the above (b), for example, both the tilting operation detecting push switches 400*a* and 400*b* are turned on by tilting the operating member 100 from the center in a direction between the tilting operation detecting push switches 400*a* and 400*b* (a direction angle of 45°). Exactly the same operations can be obtained when the operating member 100 is tilted in other directions (direction angles of 135°, 225° or 315°). In other words, eight directions can be detected. It is also possible to limit detecting directions to four directions by providing the fixed portion 310 with protrusions or raised portions.

If the operating member 100 is tilted from the center (initial return position), it is then returned automatically to the center by elastic forces of the operating member returning elastic bodies 600*a*-600*d* and the like. Because the biasing forces of the operating member returning elastic bodies 600*a*-600*d* are acting on positions very close to the shaft portion 111 of the operating member 100 having the smallest diameter (the biasing forces actually act on the outer surface of the cylindrical portion 322), the biasing forces exert small influences on a rotary torque in the rotation of the rotary knob 121. Therefore, a user would not feel that the rotary knob 121 is heavy in the rotating operation.

It is impossible to push down the rotary knob 121 of the operating knob 120. It is only the push button 122 that can be pushed down.

If the push button 122 is pushed down, only the inner shaft 110 of the operating member 100 moves downward. When the bottom face 1121 of the hemispherical support portion 112 of the inner shaft 110 pushes the head portion of the key top 430*e*, the snap plate 420*e* bends to turn on the tilting operation detecting push switch 400*e*, and the corresponding contact output is output through the output terminals 720.

If the pushing operation detecting push switch 400*e* is turned on and the push button 122 is further pushed down, the key top 430*e* contracts. If the push button 122 is further pushed down, the step 4331*e* of the key top 430*e* comes in contact with an upper face of the cylindrical body 211*e* of the lower case 210. In other words, the step 4331*e* functions as the stopper to prevent the snap plate 420*e* from taking a force equal to or greater than the spring load. In this way, it is possible to prevent failure of the input device due to contact failure caused by improper operation.

When the rotary knob 121 is rotated, the outer shaft 320 of the operation support portion 300 rotates in the direction as the knob 121 is rotated. As a result, the annular rotary body 800 rotates and signal outputs of the rotating operation detecting sensors 900 are output through the output terminals 720. When only the rotating operation is performed without tilting operation, the pushing portion 323 of the outer shaft 320 rotates without contacting the key tops 430*a*-430*d*. Consequently, the rotating operation can be performed without impairing operability.

When the tilting operation and the rotating operation are performed simultaneously, the outer shaft 320 tilts and rotates accordingly. As a result, the corresponding contact outputs of the tilting operation detecting push switches 400*a*-400*d* and the signal outputs of the rotating operation detecting sensors 900 are output through the output terminals 720.

Because the push button 122 does not rotate when the rotary knob 121 is rotated, it is possible to put letters or graphics on the head portion of the push button 122, which greatly improves usability. Because the push button 122 is a separately provided from the rotary knob 121, operation of the rotary knob would not lead to an operation mistake such as turning on of the push button.

It is possible to retrofit the operating knob 120. In other words, a user may install the input device from a back side of a case or a main board of a product to make a set (a game machine or other various products) and mount the operating knob from the front side. In this case, it is easy to mount a operating knob choosing from various types of operating knobs of different paints, colors, letters, etc.

Because the outer shaft 320 and the annular rotary body 800 are coupled by means of the pair of bosses 3231 of the outer shaft 320 and the pair of groove portions 811 of the annular rotary body 800, a special coupling mechanism is unnecessary. Therefore, it is possible to reduce the cost of the device.

It is needless to say that the compound operation input device according to the invention may be changed in the general shape and the means and configurations for signal outputting, etc. and not limited to those described in the above embodiment. The operation support portion may be changed in design as needed as long as it can support the operating member in tiltingly, rotatingly and pushingly operable manner. In each of the tilting operation detecting push switch and the pushing down operation detecting push switch, the snap plate may be formed separately from the movable contact, and the key top may be changed in design as long as it is contactable with the top portion of the snap plate and is elastically extendable and contractable in the axial direction. The type of the rotating operation detecting sensor is not especially limited and an optical sensor may be used.

What is claimed is:

1. A compound operation input device comprising:

a case;

an operating member for pushing operation, tilting operation and rotating operation, having a push button for pushing operation and a rotary knob for rotating operation;

an operation support portion for supporting the operating member in a pushingly, tiltingly and rotatingly operable manner; and at least one of a tilting operation detecting push switch and a pushing operation detecting push switch, disposed to be contactable with a base end side of at least one of the operation support portion and the operating member, the push switch including:

a snap plate, provided integrally with or separately from a movable contact corresponding to a fixed contact and a key top with one end portion contactable with a top portion of the snap plate, the key top being elastically extendable and contractable in an axial direction, wherein an elastic force of the key top is set to be greater than that of the snap plate, the operating member including an inner shaft in addition to the push button and the rotary knob, the inner shaft including:

a shaft portion to pass through an operating member insertion hole in the case, and a hemispherical support portion disposed coaxially on a base end side of the shaft portion and having an end face contactable with the other end face of the key top of the pushing operation detecting push switch, the operation support portion comprising:

a fixed portion provided in the case to face the operating member insertion hole; and an outer shaft supported on the fixed portion, the fixed portion including:

a hemispherical shell-shaped bearing portion, whose inner diameter side is adapted to axially support the inner shaft for tilting operation, and whose outer diameter side is adapted to axially support the outer shaft for rotating and tilting operation in a state where the outer shaft is coaxial with the inner shaft; and an opening, formed at a top of the bearing portion for passing through the shaft portion of the inner shaft, the outer shaft including:

a hemispherical shell-shaped outer bearing portion axially supported in a rotatingly and tiltingly operable manner in a state where a distal end side of the bearing portion of the fixed portion is placed inside the outer bearing portion;

a cylindrical portion, comprising a hollow shaft for inserting the shaft portion of the inner shaft therethrough and communicating with the outer bearing portion; and a pushing portion, provided around a base end side opening of the outer bearing portion so as to push the tilting operation detecting push switch, wherein the push button is connected to a distal end of the shaft portion of the inner shaft extending out of the cylindrical portion of the outer shaft, and the rotary knob is connected to a distal end portion of the cylindrical portion of the outer shaft, the compound operation input device further comprising:

an annular rotary body rotatably provided around an outside of the outer shaft; and a rotating operation detecting sensor for detecting rotation of the annular rotary body, wherein an outer surface of the pushing portion of the outer shaft is provided with a pair of bosses arranged in symmetric positions with respect to an axial center, and an inner side of the annular rotary body is provided with a pair of grooves arranged in the axial direction to receive the pair of bosses on the outer surface of the pushing portion of the outer shaft.

2. The compound operation input device according to claim

, wherein an outer surface of the hemispherical support portion of the inner shaft is provided with a pair of grooves arranged in the axial direction and in symmetric positions with respect to an axial center, and an inner face of the bearing portion of the fixed portion of the operation support portion is provided with a pair of bosses to be received in the pair of grooves, the pair of bosses being located at the same height as a tilting operation center of the hemispherical support portion of the operating member so as to allow the tilting operation of the inner shaft and prevent the rotating operation of the inner shaft.

3. The compound operation input device according to claim 1, further comprising a wobble preventing spring, disposed to surround the pushing operation detecting push switch and having a distal end side adapted to contact and axially bias the end face of the hemispherical support portion of the operating member.

4. The compound operation input device according to claim 1, further comprising a plurality of operating member returning elastic bodies, disposed at regular intervals around an operating member insertion hole in an operation face of the case so as to directly or indirectly come in contact with and give biasing forces to an outer surface of a shaft portion of the operating member.

5. The compound operation input device according to claim 1, the key top of the push switch comprising:

a distal end side main body;

a base end side main body; and a spring interposed between the distal end side main body and the base end side main body.

* * * * *